United States Patent [19]

Feldkämper

[11] 4,357,896

[45] Nov. 9, 1982

[54] ADHESIVE APPLICATOR

[75] Inventor: Richard Feldkämper, Lengerich of Westphalia, Fed. Rep. of Germany

[73] Assignee: Windmöller & Hölscher, Lengerich of Westphalia, Fed. Rep. of Germany

[21] Appl. No.: 211,670

[22] Filed: Dec. 1, 1980

[30] Foreign Application Priority Data

Dec. 4, 1979 [DE] Fed. Rep. of Germany ..... 2948745

[51] Int. Cl.[3] ..... B05C 1/08

[52] U.S. Cl. ..... 118/262; 118/249

[58] Field of Search ..... 118/258, 259, 262, 249, 118/203

[56] References Cited

U.S. PATENT DOCUMENTS 2,868,161 1/1959 Johnson et al. ..... 118/259 X 3,057,282 10/1962 Luboshez ..... 118/259 X

FOREIGN PATENT DOCUMENTS 1146435 of 0000 Fed. Rep. of Germany .
1577766 of 0000 Fed. Rep. of Germany .
1577774 of 0000 Fed. Rep. of Germany .
2507116 of 0000 Fed. Rep. of Germany .
2652133 of 0000 Fed. Rep. of Germany .
2611625 of 0000 Fed. Rep. of Germany .

*Primary Examiner*—John P. McIntosh
*Attorney, Agent, or Firm*—Fleit & Jacobson

[57] ABSTRACT

An adhesive applicator comprises a reservoir closed at the front by a driven applicator roller, sealing rollers which are drivable in mutually opposite directions and can be applied to the applicator roller, and doctor blades carried by sidewalls of the reservoir and acting on the sealing rollers.

8 Claims, 2 Drawing Figures

ADHESIVE APPLICATOR

The invention relates to an adhesive applicator comprising a reservoir of which the front is closed by a vertically upright mounted adhesive roller which is provided with a rotary drive and is sealed from the adjacent walls on both sides by sealing elements running parallel to their surface lines, and comprising a transfer roller of which the surface or pattern members can be applied to the surface of the adhesive roller to take adhesive therefrom.

In an apparatus of this kind known from DE-AS No. 11 46 435, the sealing elements consist of sealing strips which must bound such a wide gap at the side of the surface of the adhesive roller projecting from the reservoir that a film of adhesive of the desired thickness is formed on the adhesive roller, and they must prevent excess quantities of adhesive from leaving, which is impossible particularly in the case of thin adhesives and during standstill periods. Further, the sealing strip on the side of the adhesive roller surface running into the reservoir has to scrape therefrom the adhesive film not taken by the applicator roller and consequently the excessive adhesive flows off and results in soiling of parts of the apparatus.

It is therefore the problem of the present invention to provide an adhesive applicator of the aforementioned kind in which the discharge of excessive adhesive or the flowing off of adhesive not taken from the adhesive roller is to a large extent avoided.

According to the invention, this problem is solved in that the sealing elements disposed in the gaps between the adhesive roller and the edges of the adjacent walls consist of rotatable rollers which have axes parallel to the adhesive roller axis, can be applied to the surface of the adhesive roller to form adhesive penetrating gaps and are drivable in opposite directions so that their parts applied to the adhesive roller move towards the interior of the reservoir and the circumferential speed of the roller turning opposite to the adhesive roller is higher than the circumferential speed of the latter, and that the gaps between the walls and the rollers are closed by doctors which are secured thereto and sealingly engage the rollers. The rollers of the adhesive applicator according to the invention on the one hand bound an outlet gap so that an adhesive film of the desired thickness can be formed on the adhesive roller and on the other hand they prevent an accumulation of unconsumed adhesive in front of the inlet gap that might flow off. The doctors are sealingly applied to the rollers so that no gap remains out of which adhesive could escape from the reservoir.

Desirably, the rollers are movable relatively to the adhesive roller to adjust the gap between the latter and the rollers.

To avoid the escape of adhesive during standstill periods, the rollers can be sealingly applied to the surface of the adhesive roller.

One example of the invention will now be described in more detail with reference to the drawing, wherein.

Figure 1:
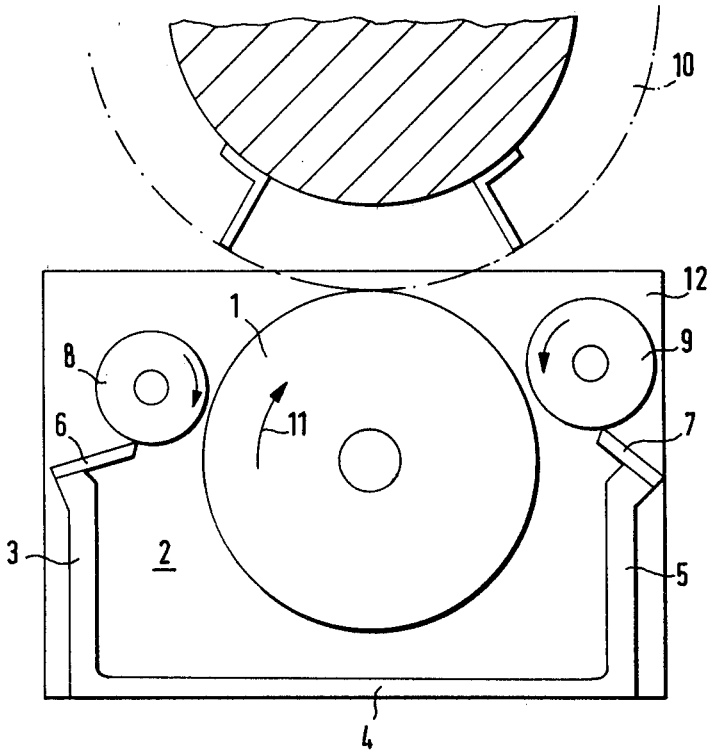
FIG. 1 is a plan view of an adhesive apparatus.

The adhesive apparatuses illustrated in the drawing serve to apply strips of adhesive to continuously moving webs of material or workpieces.

The interior 2 of a reservoir for the adhesive that is open at the top is closed at the front by the adhesive roller 1 as well as by the rollers 8, 9 and the doctors 6, 7. The reservoir is additionally bounded by the side walls 3, 4, 5 and the base plate 12. The doctors 6, 7 are secured to the free ends of the walls 3 and 5 and sealingly abut the surfaces of the rollers 8, 9.

The adhesive roller 1 is at a tangent to the circle described by the contour members of a format cylinder 10.

The adhesive roller 1 turns in the direction of the arrow 11. The two stripping rollers 8, 9 turn oppositely to the adhesive roller 1. They are scraped by the doctors 6 and 7 and can be applied to and removed from the adhesive roller 1 and also adjusted in relation to the roller gap. The chamber 2 is closed at the bottom by a plate 12 to which the walls 3 to 5 are securely connected and with which the lower ends of the rollers 1, 8, 9 are sealingly engaged.

The adhesive roller 1 turns slowly in known manner. The rotary speed of the stripping roller 8 is less than that of the adhesive roller 1. The thickness of the film of adhesive on the adhesive roller 1 is metered by the gap between the the roller 8 and adhesive roller 1. The stripping roller 9 turns more rapidly than the adhesive roller 1. The adhesive expelled between the rollers 1 and 9 under the static pressure is thereby recovered into the chamber 2. Similarly, the adhesive not withdrawn from the roller 1 is returned through the gap between the rollers 1 and 9.

The rollers 8 and 9 are pivotably mounted. When there is a standstill in the production of the machine, they can be applied to the roller 1. The gap between this roller and the rollers 8 and 9 is adjustable.

Figure 2:
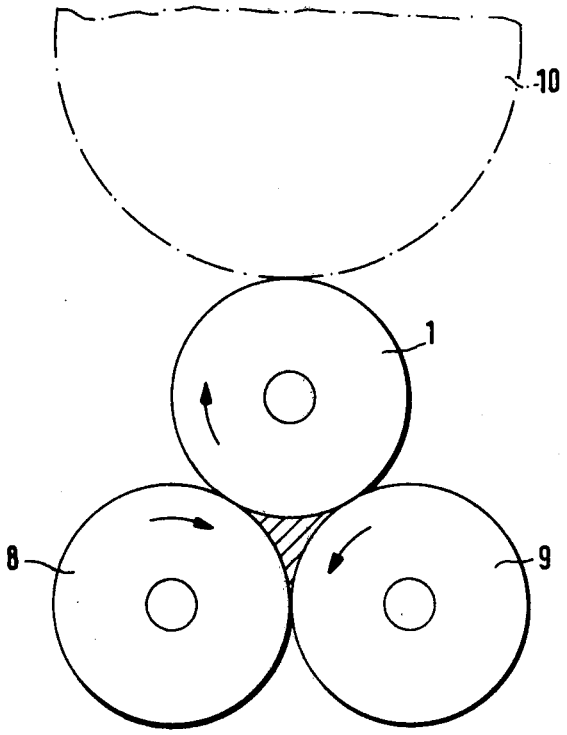
FIG. 2 is a plan view of another embodiment of an adhesive apparatus in which the lateral rollers are in contact.

FIG. 2 illustrates an embodiment of an adhesive apparatus in which the lateral rollers 8, 9 are not only applied to the adhesive roller 1 but also contact each other along surface lines. The rollers 8, 9 and the adhesive roller 1 together define a nip in which there is an accumulation of the excessive adhesive which is fed back to the reservoir by the lateral roller 8,9. The adhesive apparatus of FIG. 2 is of simpler construction and can be more easily cleaned.

At a low speed for the adhesive roller 1, the thickness of the application is larger than at higher speeds because the static pressure will press more adhesive through the gap. It is therefore advantageous to drive the roller 8 at a basic rotary speed when the adhesive roller 1 has a low speed. At a higher speed for the adhesive roller 1, the speed of the roller 8 can again increase proportionally. This is possible by building a free-wheeling device into the drive for the roller 8.

At a low speed for the adhesive roller 1, the roller 9 preferably turns at twice the speed so as to be sure to draw in the adhesive located on the adhesive roller 1.

At a higher speed for the adhesive roller 1, however, it is possible to make the speed for the roller 9 less than that of the adhesive roller 1 because it will then also be ensured that the adhesive is drawn in.

Desirably, the spacing between the rollers 8 and 9 from the adhesive roller 1 is set simultaneously, it being possible for the widths of the gaps to be equal. Preferably, the gap between the roller 9 and the adhesive roller 1 is set 0.1 to 0.2 mm larger than is the gap between the roller 8 and the adhesive roller 1.

Hitherto, the adhesive format was lifted off the adhesive roller in the absence of a sack in order to achieve a uniform application of adhesive. Lifting off of the adhesive format can be dispensed with by scraping all of the adhesive from the adhesive roller in the absence of a sack.

To clean the equipment, it can be turned through 90° so that the rollers are disposed horizontally.

I claim:

1. An adhesive applicator comprising a reservoir having bottom, rear, and side walls, and an open front; an upright mounted adhesive roller positioned so as to close a central portion of the front of the reservoir, gaps being defined between a circumferential surface of the adhesive roller and the side walls of the reservoir; rotary drive means for rotating said adhesive roller; and sealing means disposed in the gaps between the adhesive roller and the side walls for sealing the gaps comprising rotatable rollers for sealing first portions of the gaps and having axes extending parallel to an axis of the adhesive roller and being positioned with respect to the surface of the adhesive roller to form adhesive penetrating gaps therebetween, the rotatable rollers being drivable in opposite directions so that parts of the rotatable rollers confronting the adhesive roller move towards the interior of the reservoir, the circumferential speed of one of the rotatable rollers turning opposite to the adhesive roller being higher than the circumferential speed of the adhesive roller; and doctors secured to said side walls for sealingly engaging the rotatable rollers to thereby seal second portions of said gaps located between said side walls and said rotatable rollers.

2. An adhesive applicator according to claim 1, characterised in that the rotatable rollers are movable relative to the adhesive applicator roller to adjust the size of the adhesive penetrating gaps between the adhesive roller and the rotatable rollers.

3. An adhesive applicator according to claim 8 or claim 2, characterised in that the rotatable rollers are movable into positions engaging the circumferential surface of the adhesive roller.

4. An adhesive applicator according to one of claims 1 or 2, characterised in that one of the rotatable rollers rotates in the same direction as the adhesive roller and one of the rotatable rollers rotates in the opposite direction, the rotatable roller rotating opposite to the adhesive roller being driven at a basic rotary speed when the adhesive roller turns at a low circumferential speed.

5. An adhesive applicator according to claim 4, characterised in that, at a low speed of the adhesive roller, the rotatable roller turning in the same direction turns at about twice the speed of the adhesive roller.

6. An adhesive applicator according to claim 5, characterised in that at a higher speed of the adhesive roller, the speed of the rotatable roller turning in the same direction is less than that of the adhesive roller.

7. An adhesive applicator according to one of claims 1 or 2, characterised in that one of the rotatable rollers rotates in the same direction as the adhesive roller and one of the rotatable rollers rotates in the opposite direction, and that, at a low speed of the adhesive roller, the rotatable roller turning in the same direction turns at about twice the speed of the adhesive roller.

8. An adhesive applicator according to claim 7, characterised in that at a higher speed of the adhesive roller, the speed of the rotatable roller turning in the same direction is less than that of the adhesive roller.

* * * * *